US005477583A

United States Patent [19]

Deloe

[11] Patent Number: 5,477,583

[45] Date of Patent: Dec. 26, 1995

[54] WATER ASSISTED CLEANING IMPLEMENT FOR MOWING MACHINERY

[76] Inventor: Thomas L. Deloe, 458 Bolivar Dr., Bradford, Pa. 16701

[21] Appl. No.: 261,191

[22] Filed: Jun. 13, 1994

Related U.S. Application Data

[63] Continuation-in-part of Ser. No. 75,793, Jun. 14, 1993, abandoned.

[51] Int. Cl.[6] ..... A47L 25/00

[52] U.S. Cl. ..... 15/236.01; 239/289

[58] Field of Search ..... 239/289, 505, 239/563, 518, 524; 15/236.01, 405; 401/261, 265, 266, 267

[56] References Cited

U.S. PATENT DOCUMENTS

| | | | |
|---|---|---|---|
| D. 300,453 | 3/1989 | Proctor et al. | D23/226 |
| 1,018,518 | 2/1912 | Pettit | 15/236.01 |
| 1,239,176 | 9/1917 | Gilbert | 15/236.01 |
| 2,289,889 | 7/1942 | Stick et al. | 299/111 |
| 2,607,622 | 8/1952 | Doepke | 239/530 X |
| 2,638,730 | 5/1953 | Davidson | 239/754 X |
| 3,070,823 | 1/1963 | Heinig | 401/261 X |
| 3,106,397 | 10/1963 | Hayes | 239/505 |
| 4,485,516 | 12/1984 | Crook | 15/236.01 |
| 4,575,270 | 3/1986 | Hammond | 401/140 |
| 4,840,313 | 6/1989 | Hansen | 239/456 |
| 4,880,165 | 11/1989 | Fuquay | 239/525 |
| 5,037,028 | 8/1991 | Evans | 239/1 |
| 5,072,486 | 12/1991 | Guarascio | 15/401 |

*Primary Examiner*—Kevin P. Weldon

*Attorney, Agent, or Firm*—David L. Baker; Rhodes & Ascolillo

[57] ABSTRACT

An implement for cleaning mowing machinery, adapted for connection to the end of a hose, which receives a pressurized supply of water. The implement includes a tube, a channel for passage of the pressurized water extending through the tube, a connection mechanism for connecting one end of the tube to the hose, and a scraper element disposed at the other end of the tube. The scraper element has a base section, a hosel-like neck section, connected to one end of the base section, and a water outlet positioned over the base section. Finally, there is a pivot mechanism for adjustably rotating the scraper element about the tube through a range of approximately 180 degrees.

6 Claims, 3 Drawing Sheets

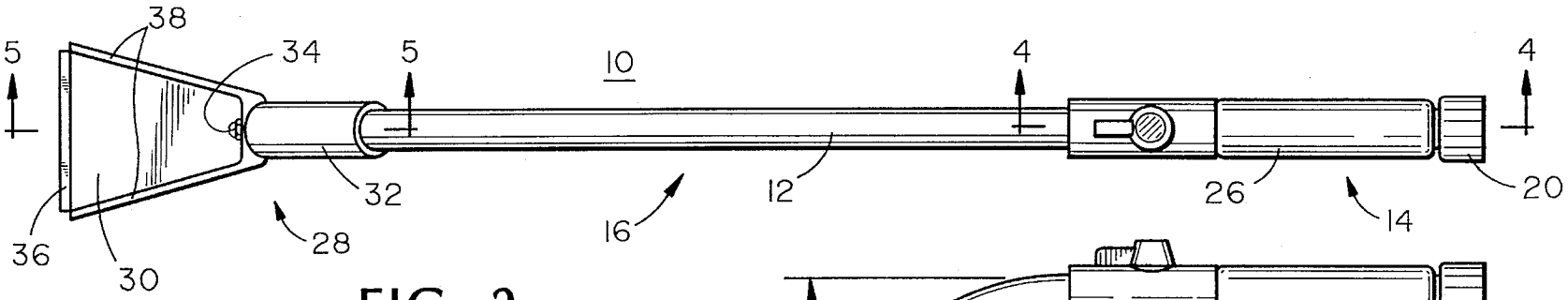
FIG. 2
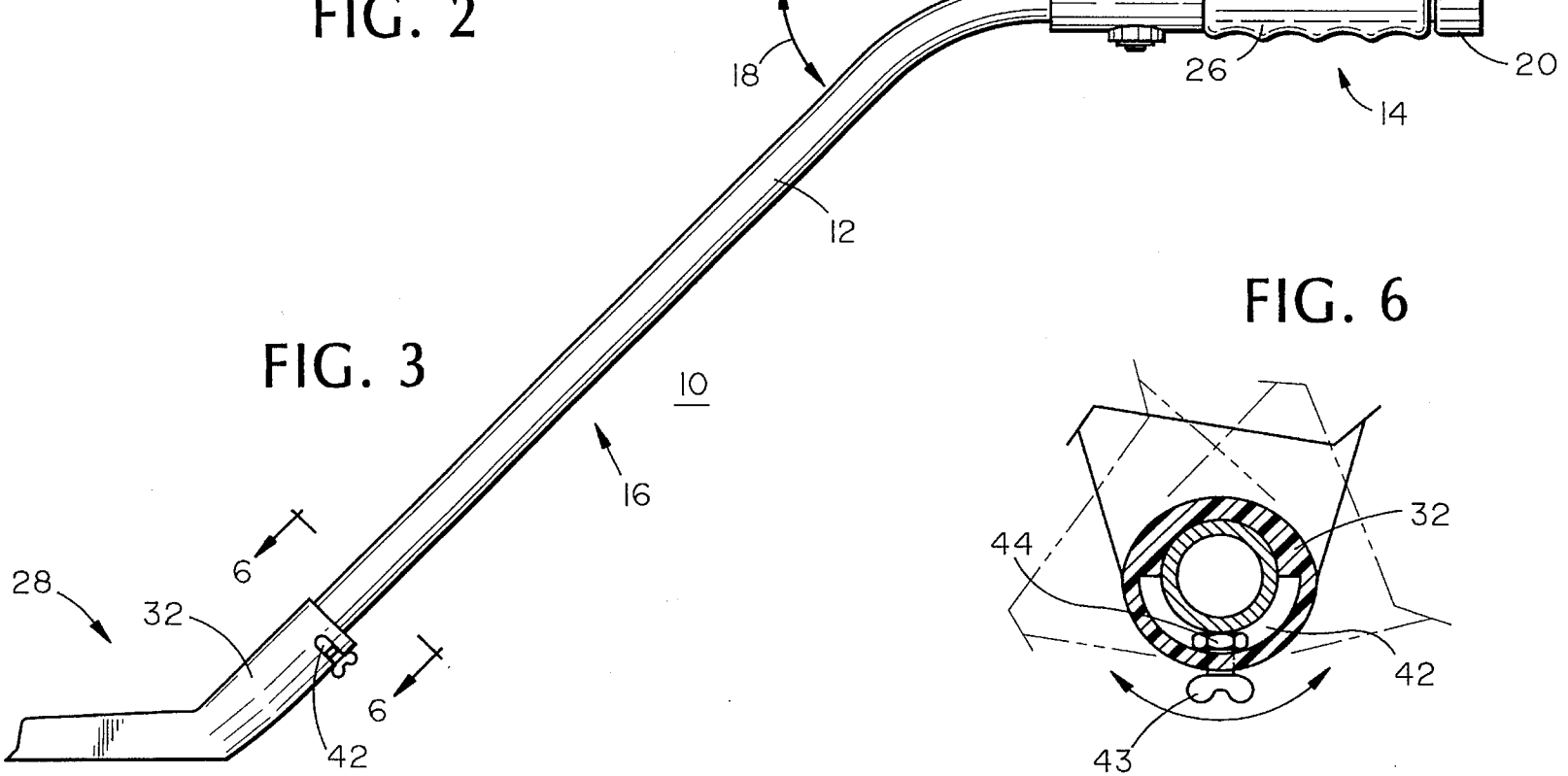
FIG. 3
FIG. 6

WATER ASSISTED CLEANING IMPLEMENT FOR MOWING MACHINERY

This application is a continuation-in-part of a prior application, Ser. No. 08/075,793, filed on Jun. 14, 1993, now abandoned.

BACKGROUND OF THE INVENTION

1. Field of the Invention

The present invention relates to implements that are used to clean machinery designed for mowing grasses, and more particularly, to those implements which are readily connectible to ordinary garden hoses.

2. Description of the Related Art

U.S. Pat. No. 4,840,313 relates to a water spray fitting for controlling the flow from a pressured supply of water, such as a hose. The fitting includes a valve member extending longitudinally through the body of the fitting, and a vertical control ring that threadingly engages the valve member, such that rotation of the control ring moves the valve member horizontally to increase or decrease the flow of water.

U.S. Pat. No. 5,037,028 discloses a multi-functioning water directing device that includes an input garden hose coupler, a series of straight pipe sections, a U-shaped transition pipe section, a straight output water-directing jetting segment, and a handle. Due to its extended configuration, the device is said to be adaptable to a number of uses, such as removing debris from the rain gutters of a dwelling, washing a high riding vehicle, and serving as a sprinkler device.

U.S. Pat. No. 4,575,270 relates to a hose end sprayer for introducing a chemical concentrate into the flow, most particularly a detergent for washing vehicles. The hose end sprayer includes a baffle for creating a back pressure that gradually forces the chemical concentrate from a reservoir, through a hole, and into the flow.

U.S. Pat. No. 4,880,165 relates to a hand held spray device, such as those used by beauty salon operators, that is equipped with a loop on the spray head thereof. The operator inserts a finger through the loop in order to more easily direct the spray.

U.S. Design Pat. No. 300,453 discloses a design for a combined hose attached pressure sprayer and connector for attachment to an additive fluid dispenser.

Other patents of interest include the following: U.S. Pat. No. 2,289,889, issued to Stick; and U.S. Pat. No. 5,072,486 issued to Guarascio.

SUMMARY OF THE INVENTION

Mowing machinery routinely becomes fouled underneath with caked on debris, predominantly grass and mud. Proper cleaning extends the life of the equipment, deters corrosion, and maintains an efficient mower mulching action, by allowing the clippings to rise up and drop to the blade for a second cut.

Accordingly, it is one object of the present invention to provide a cleaning implement that effectively removes debris from the deck of mowing machinery, particularly home and commercial lawn mowers.

Another object of the invention is to provide a cleaning implement that uses the force of water along with a specially dimensioned tool in order to accomplish the above task.

Another object of the present invention is to provide a cleaning implement having a pivoting scraper head for easier cleaning of difficult to reach areas.

A still further object of the invention is the provision of such a cleaning implement that can be easily connected to a conventional yard hose, that is easy to use, and that is simple in construction and therefore inexpensive to manufacture.

The present invention achieves the above objects, among others by providing, in one aspect, an implement for cleaning mowing machinery, adapted for connection to the end of a hose, which receives a pressurized supply of water. The implement includes a tube, a channel for passage of the pressurized water extending through the tube, a connection mechanism for connecting one end of the tube to the hose, and a scraper element disposed at the other end of the tube. The scraper element has a base section, a hosel-like neck section, connected to one end of the base section, and a water outlet positioned over the base section. Finally, there is a pivot mechanism for adjustably rotating the scraper element about the tube through a range of approximately 180 degrees.

Preferably, the tube has a first section and a second section, disposed at an oblique angle with respect to one another, with the connection mechanism being disposed on the first section of the tube, and the scraper element being disposed on the second section of the tube. In addition, there is a handle grip which surrounds the first section of the tube. Preferably, the base section of the scraper element is substantially trapezoid shaped, including a tapered leading edge running along one side and upwardly protruding walls running along all other sides. A valve mechanism is located between the first and second sections of the tube for regulating the flow of the pressurized water through the tube.

In another aspect, the invention generally features an implement for cleaning mowing machinery, adapted for connection to the end of a hose, which receives a pressurized supply of water. It includes a substantially rigid and non-flexible tube, having first and second sections, a connector positioned on one end of the tube for connection to the end of the pressurized water hose, a spray device positioned on the other end of the tube for spraying the pressurized water, and a water passage passing through the tube member. A scraper element is positioned on the other end of the tube, which features a trapezoidal base section, having a tapered leading edge and upwardly protruding side walls, a hosel-like neck section, connected to one end of the base section, and the spray device, which is positioned over the base section. Finally, a pivot mechanism is included for adjustably rotating the scraper element about the tube through a range of approximately 180 degrees.

Preferably, the implement additionally includes a valve mechanism, disposed between the first and second sections of the tube, for regulating the flow of the pressurized water through the water passage.

The pivot mechanism features a slotted channel disposed on an outside surface of the neck section, a nut firmly attached to an outside surface of the second section of the tube, and a wing bolt threadingly and removably engaged with the nut. When the second section of the tube is fully inserted into the neck section, the nut is aligned with the slotted channel such that the wing bolt may be inserted therethrough.

The invention will now be described by way of a particularly preferred embodiment, reference being made to the accompanying drawings, wherein:

BRIEF DESCRIPTION OF THE DRAWINGS

FIG. 2 is a top plan view of the cleaning implement of FIG. 1;

FIG. 3 is a side elevational view;

FIG. 6 is a cross sectional view, taken along lines 6—6 of FIG. 3, of the neck section of the scraper element, illustrating its range of rotational motion about the tube.

DESCRIPTION OF THE PREFERRED EMBODIMENT

Figure 1:
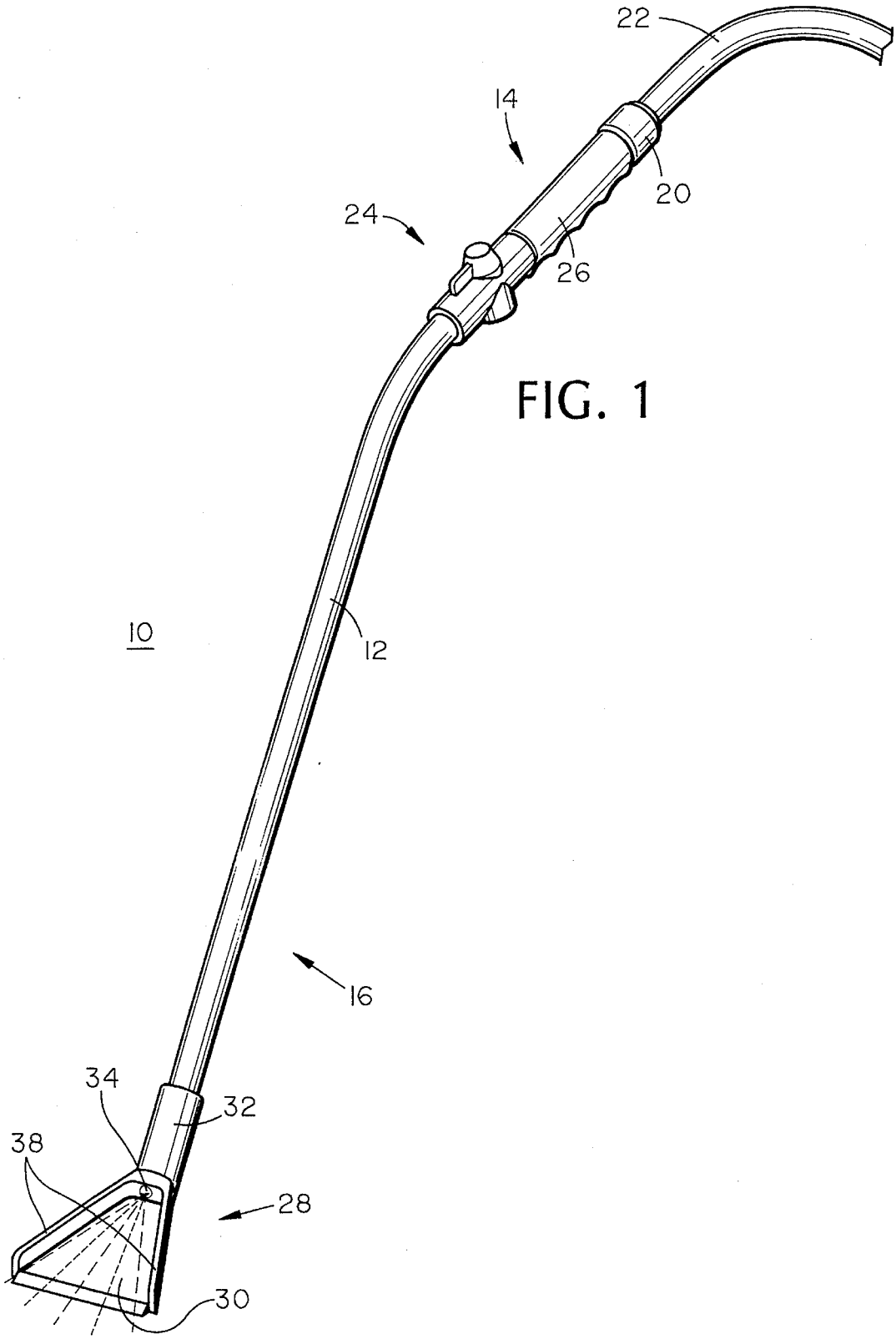
FIG. 1 is a perspective view of a water assisted cleaning implement constructed according to the present invention.

Referring initially to FIGS. 1–3, there is shown a water assisted cleaning implement 10 that is particularly adapted for cleaning the debris from mowing machinery, most particularly, the debris that normally collects beneath and around the mowing deck of a home or commercial lawn mower.

The cleaning implement 10 generally includes a tube 12, having a first section 14 and a second section 16. As is seen most clearly in FIG. 3, the first and second tube sections 14 and 16 are aligned at an oblique angle 18 with respect to one another. Preferably, the angle of obliqueness 18 is between about 30 degrees and 45 degrees, and even more preferably, the angle 18 is substantially equal to about 45 degrees. The second tube section 16 is preferably constructed from a rigid tubing, for example, steel, aluminum, a rigid plastic, etc., and is preferably 18 inches in length and has an outside diameter of about ½ inch. The construction of the first tube section 14 is discussed further below.

The distal end of the first section 14 is provided with a connector 20 for connecting to a hose 22 (seen most clearly in FIG. 1) that is capable of providing a supply of pressurized water. The first tube section 14 further generally includes a valve mechanism 24, for controlling the flow of water through the tube 12, and a handle grip 26 for furnishing a user of the cleaning implement 10 with a comfortable grip.

The distal end of the second section 16 fits into a scraper element 28 having a base section 30, a hosel-like neck section 32 connected to the base section 30, and a water outlet 34 positioned over the base section 30. Preferably, the water outlet 34 is a device having a nozzle fitting of a type that emits a concentrated, high pressure "fan shaped" spray of water. In the preferred embodiment described herein, the base section 30 of the scraper element 28 is trapezoidal in shape, furnished with a tapered leading edge 36 and surrounding, upwardly projecting sidewalls 38.

Figure 5:
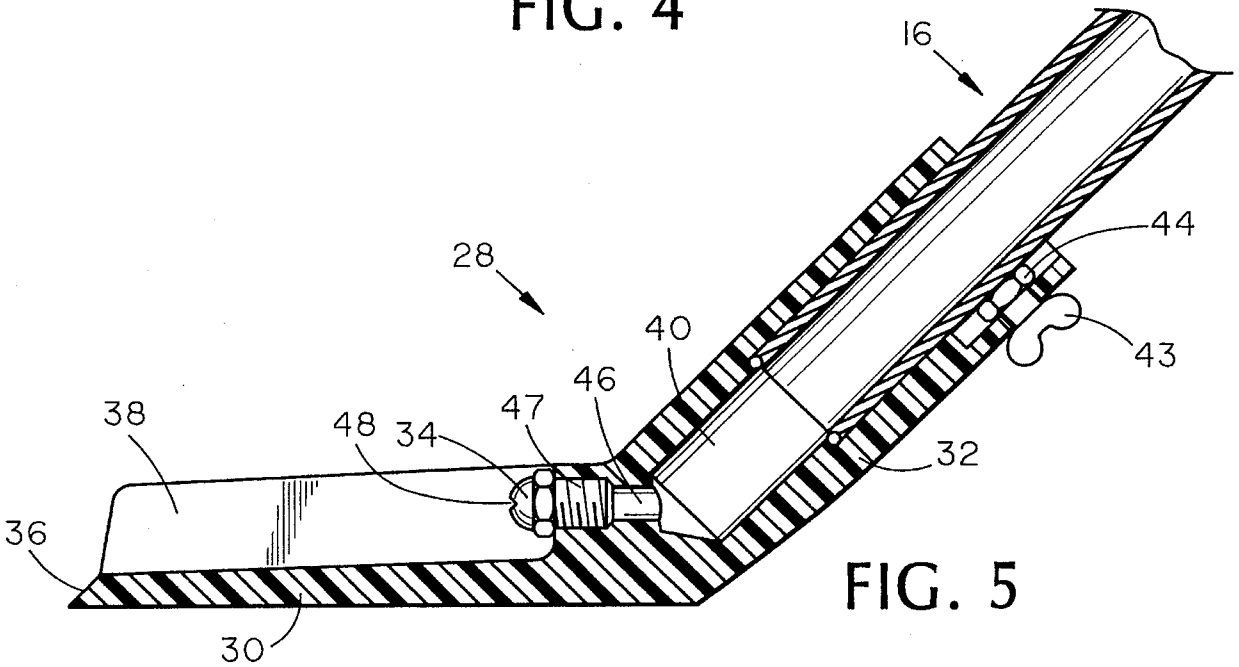
FIG. 5 is a cross sectional view, taken along lines 5—5 of FIG. 2, illustrating the scraper element and its tube attaching mechanism.

As can be seen in FIGS. 5 and 6, the neck section 32 of the scraper element 30 is configured as to provide adjustable and pivotal rotation about the tube 12. A throughgoing bore 40 in the neck section 32 receives the second tube section 16 to a point where the bore 40 is narrower than the outside diameter of the second tube section 16. Located on the perimeter of the neck section 32 is a channeled slot 42 which extends substantially 180 degrees around the outside surface thereon. The slot 42 accepts a throughgoing wing bolt 43 which, in turn, engages a nut 44 firmly attached to the second tube section 16. The neck section 32 has a somewhat larger inside diameter at its top to accommodate the extra width of the second tube section 16 (attributable to the nut 44), to a point where the nut 44 is aligned with the channeled slot 42. By disengaging the wing bolt 43 from the nut 44, the entire scraper element 30 is free to rotate about the second tube section 16 to a desired position, whereby the wing bolt 43 may be reattached.

The bore 40 communicates with a passageway 46 that leads to the water outlet 34, which preferably includes a threaded nozzle plug 47 having a slit opening 48 so as to produce a relatively "flat" and "fan shaped" high pressure stream of water; the lateral direction of the ejected water stream is controlled by sidewalls 38.

Figure 4:
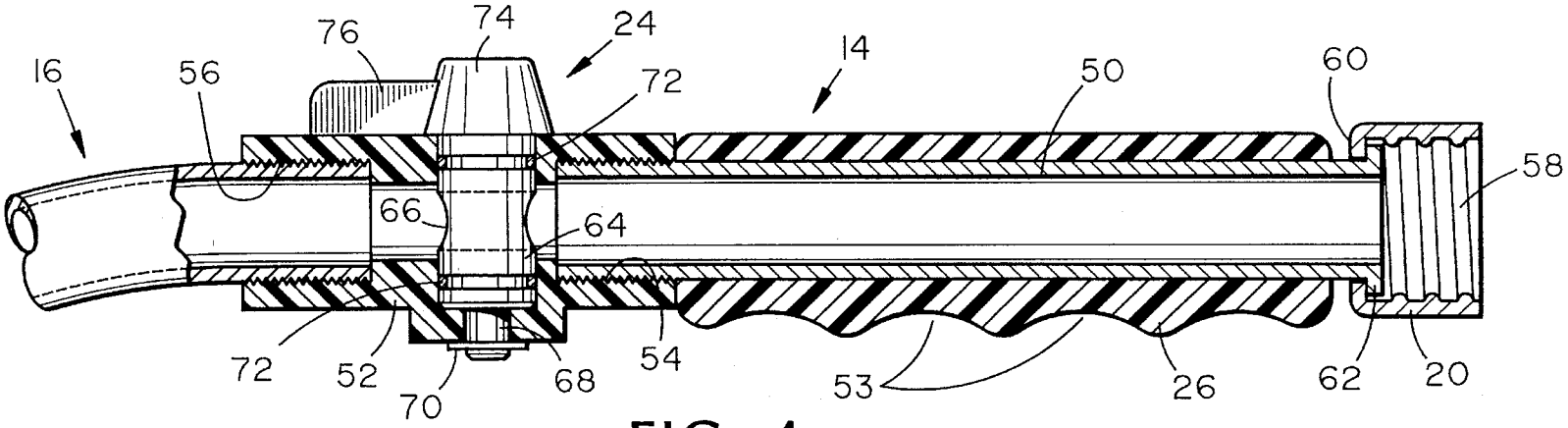
FIG. 4 is a cross sectional view, taken along lines 4—4 of FIG. 2, of a handle grip and a valve that are positioned on one end of the cleaning implement.

Referring now to FIG. 4, the first tube section 14 preferably includes a relatively short tube segment 50, a valve body 52, the connector 20, and the handle grip 26 surrounding the short tube segment 50. The handle grip 26 features a series of finger indents, as at 53. As shown, the short tube segment 50 and the second tube portion 16 are connected to the valve body 52 by threaded fittings 54 and 56, respectively. The connector 20, which is provided with a female threaded fitting 58 for connection to the hose 22, is rotatably maintained via a pair of abutting annular flanges 60 and 62 provided on the connector 20 and the short tube segment 50, respectively.

Finally, the valve mechanism 24 includes the valve body 52, a valve stem 64 passing preferably vertically therethrough and having a valve aperture 66, a rotatable shaft 68, upon which the valve stem 64 is mounted, an "E-ring" retainer 70 for securing the shaft 68, and a pair of "O-rings" 72 for preventing water leakage. The valve mechanism 24 further includes a valve handle 74 for operation of the valve mechanism 24, with the valve handle 74 having a valve lever 76 protruding therefrom for easier rotation and for indicating the rotational. positioning of the valve stem 64.

While the invention has been herein described by way of a particular preferred embodiment, various substitutions of equivalents may be effected without departing from the spirit and scope of the invention as set forth in the following claims.

What is claimed is:

1. An implement for cleaning mowing machinery, being adapted for connection to the end of a hose, with the hose receiving a pressurized supply of water, said implement comprising:

a tube comprising;

a first section; and a second section, disposed at an oblique angle with respect to one another;

a channel for passage of the pressurized water extending through the tube;

connection means for connecting one end of the tube to the hose;

the connection means is disposed on the first section of the tube;

a scraper element disposed at another end of the tube, including:

a substantially trapezoid shaped base section;

a tapered leading edge running along one side and upwardly protruding walls running along all other sides of the base section;

a hosel-like neck section, connected to one end of the base section; and a water outlet positioned over the base section;

pivot means for adjustably rotating the scraper element about the tube through a range of approximately 180 degrees;

the scraper element is disposed on the second section of the tube; and a handle grip surrounding the first section of the tube.

2. The cleaning implement as described in claim 1, wherein the cleaning implement additionally comprises valve means located between the first and second sections of the tube for regulating the flow of the pressurized water through the tube.

3. An implement for cleaning mowing machinery, being adapted for connection to the end of a hose, with the hose receiving a pressurized supply of water, said implement comprising:

a substantially rigid and nonflexible tube, having first and second sections;

a connector positioned on one end of the tube for connection to the end of the pressurized water hose;

a spray device positioned on the other end of the tube for spraying the pressurized water;

a water passage passing:through the tube member;

a scraper element positioned on the other end of the tube, including:

a trapezoidal base section, having a tapered leading edge and upwardly protruding side walls;

a hosel-like neck section, connected to one end of the base section; and the spray device, which is positioned over the base section; and pivot means for adjustably rotating the scraper element about the tube through a range of approximately 180 degrees.

4. The cleaning implement as described in claim 3, additionally comprising a hand grip surrounding the first section of the tube.

5. The cleaning implement as described in claim 4, additionally comprising valve means, disposed between the first and second sections of the tube, for regulating the flow of the pressurized water through the water passage.

6. The cleaning implement as described in claim 5, wherein the pivot means further comprises:

a slotted channel disposed on an outside surface of the neck section;

a nut firmly attached to an outside surface of the second section of the tube; and a wing bolt threadingly and removably engaged with the nut.

* * * * *